United States Patent [19]

Gahm

[11] 4,448,327

[45] May 15, 1984

[54] PLASTIC CONTAINER HAVING A CONCEALED HINGE

[75] Inventor: William J. Gahm, Jamesburg, N.J.

[73] Assignee: Graber-Rogg, Inc., Cranford, N.J.

[21] Appl. No.: 404,453

[22] Filed: Aug. 2, 1982

[51] Int. Cl.[3] ..... B65D 43/14; B65D 51/04

[52] U.S. Cl. ..... 220/341; 220/337

[58] Field of Search ..... 220/337, 341, 338

[56] References Cited

U.S. PATENT DOCUMENTS 3,394,835 7/1968 Peterson ..... 220/337

4,349,121 9/1982 Lafferty ..... 220/341

*Primary Examiner*—George T. Hall

*Attorney, Agent, or Firm*—Lipari, Keefe & Champi

[57] ABSTRACT

An improved plastic container is composed of a base, a cover for mating with the base, and a concealed pivotal hinge pin unit having a body portion and end portions which are connected to the cover and base respectively for providing pivotal movement thereof.

7 Claims, 6 Drawing Figures

PLASTIC CONTAINER HAVING A CONCEALED HINGE

PRIOR ART

This invention relates to plastic containers, and more particularly to relatively small plastic containers, such as compact containers which are utilized for holding cosmetics, pills, coins and the like.

In the prior art, relatively small, plastic containers, either when in an open or closed position, revealed its pivotal means such that the container was aesthetically unattractive. Further, the pivotal means generally revealed the end portions of the hinge pins, when viewed externally of the container, which were utilized in joining the base to the cover. Also, the positioning of the pins within the containers were located in such a manner that, at times, the pins could easily be dislodged.

SUMMARY OF THE INVENTION

Accordingly, among the principal objects of the present invention, is an improved plastic container whose pivotal means, for providing relative movement between the base and cover, is concealed when the container is viewed from its exterior.

Still yet another object of the present invention is to provide an improved plastic container having a pivotal means for providing relative movement between the base and cover which includes a hinge pin that is not capable of being viewed from the exterior surface of the container.

Still yet another object of the present invention is to provide an improved plastic container having a base and a mating cover which can be easily snap fitted to a hinge pin pivotal means which is secluded from view when the container is either in an open or closed position.

In accordance with the present invention, a plastic container is comprised of a first body, a second body for uniting with said first body to form an enclosure when located within opposing relationship, and a pivotal pin having a body portion and end portions. The first body is provided with at least one pair of shoulders moulded therein in opposing relationship to each other, said pair of shoulders each having an opening therein for receiving and holding the respective end portions of said pin which is capable of being snap-fitted therein. A second body is provided with at least one moulded projection having an opening therein for receiving and holding the body portion of said pin when the first body is united with the second body, thereby rendering any portion of the pin invisible, external the container.

More specifically, the opposing shoulders each are provided with openings which are snap-fitted to the end portions of the hinge pin. Also, each projection is provided with an opening which is snap-fitted to the body portion of the hinge pin. In this manner, the hinge pin can not be viewed externally from the container, which, accordingly, enhances its aesthetic appearance.

The above description, as well as further objects, features and advantages of the present invention will be more fully appreciated by reference to the following, detailed description of the preferred, but nonetheless illustrative embodiment, when taken in conjunction with the accompanying drawings, wherein.

DESCRIPTION OF THE PREFERRED EMBODIMENTS

The container basically consists of a base, generally referred to as 10, and a cover, generally referred to as 25. The base and cover are molded from a suitable plastic material, such as acrylonitrile butadiene styrene.

Figure 2:
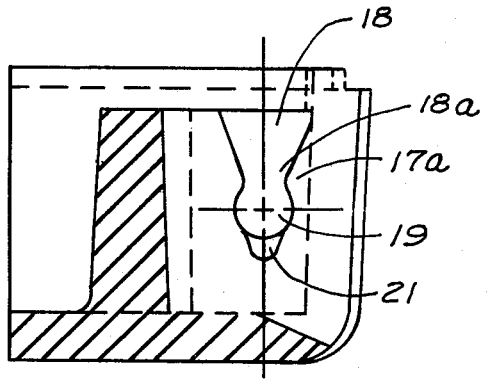
FIGS. 2 and 2A are enlarged cross-section views taken along the lines 2—2 an 2A—2A of FIGS. 1 and 5, respectively, to depict the shoulder portions.

Base 10 is of a generally rectangular configuration and provided with like opposing side walls 11—11, a front wall 12 and a rear wall 13. Located near the respective end portions of rear wall 13 and its respective end portion of each side wall 11, is a hinge receiving slot, generally referred to as 14. The hinge receiving slot 14 includes an opening 15 extending substantially the entire height of the rear wall. Opening 15 is of a width substantially equal to the width of a pair of projections, as seen in FIG. 2, of cover 25, hereinafter described in more detail.

Located within the base wall enclosure and integrally formed with the end of each side wall 11—11 and rear wall 13, and a pair of opposing shoulder portions 17A—17A and 17B—17B. The shoulder portions 17A—17A and 17B—17B each are provided with a tapered neck portion 18, as seen in FIG. 2, which converges toward a substantially circular shaped opening 19 having a diameter substantially the same size as the diameter of a hinge pin 20. The size of neck portion 18 decreases as it approaches neck portion 18A such that the diameter at that point is less than the diameter of circular shaped opening 19. The end portions 20A—20A of hinge pin 20 are received and held within its respective circular opening of each projection, such that the pin end portions are located within the circular openings and are completely concealed from the external surfaces of the base walls. Optionally, a smaller substantially U-shaped opening 21 is provided contiguous with circular opening 19 for facilitating the expansion of neck portion 18A and circular opening 19, as hinge pin 20 is snap-fitted through neck portion 18B and located within said circular opening to minimize or prevent any fracturing of the material during the snapping operation.

Figure 3:
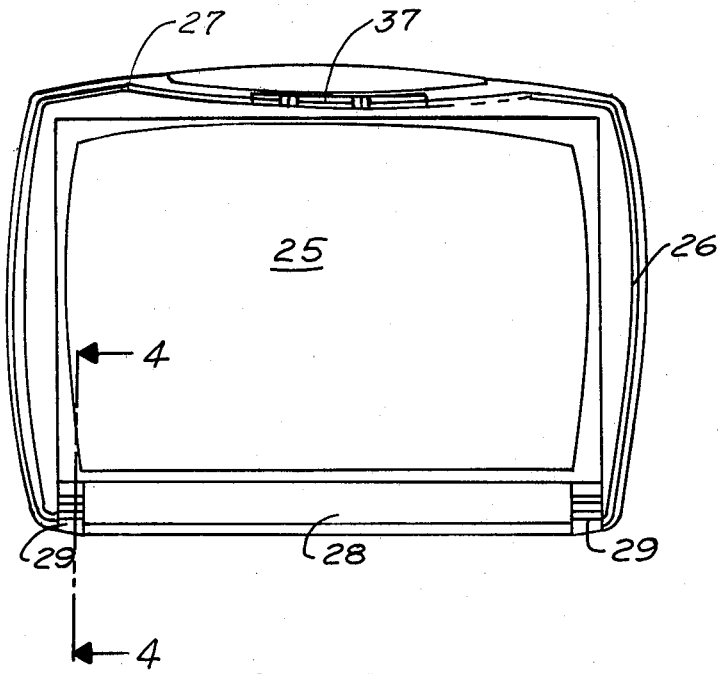
FIG. 3 is a plan view of the cover of the container made in accordance with the present invention.
Figure 4:
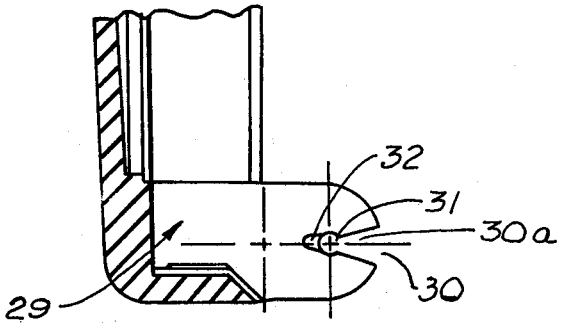
FIG. 4–4A is an enlarged cross-section view taken along the lines 4—4 and 4A—4A of FIGS. 3 and 6, respectively, to depict the projections.

Cover 25, as seen in FIG. 3, is of generally rectangular configuration, as base 10. Cover 25 is provided with like opposing side walls 26—26, a front wall 27 and a rear wall 28. Located within the cover wall enclosure and near the respective end portions of rear wall 28 are a pair of projections, generally referred to as 29—29. Each projection, as seen in FIG. 4, is constructed similarly to base shoulder portions 17A—17A and 17B—17B, and of a dimension such that each projection is capable of being substantially fully received within its respective hinge receiving slot 14. Each projection includes a tapered neck portion 30 which converges toward a substantially circular opening 31 having a diameter substantially the same size as the diameter of hinge pin 20, whose body is grasped and held within said circular opening. The size of neck portion 30 decreases as it approaches neck portion 30A such that the diameter at that point is less than the diameter of circular shaped opening 31. Optionally, a smaller substantially U-shaped opening 32 is contiguous with circular opening 31 and facilitates the expansion of neck portion 30A and circular opening 31, as hinge pin 20 is snap fitted through neck portion 30A and located within said circular opening to minimize or prevent any fracturing of the material during the snapping operation.

Projections 29—29 extend from the cover wall a distance such that it not only substantially fills hinge receiving slot 14, when it is snap fitted to hinge pin 20, but also completely conceals hinge pin 20. Accordingly, when base 10 is mated with cover 25, hinge end portions 20—20A of pin 20 are concealed within its respective shoulder circular openings 19—19, thereby rendering it invisible external the container.

Figure 1:
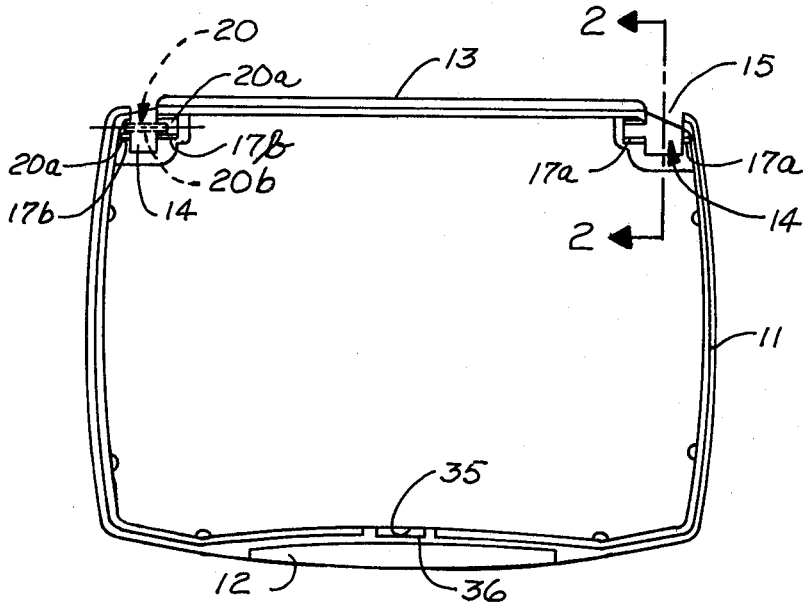
FIG. 1 is a plan view of the base of the container made in accordance with the present invention.

With respect to the opening and closing of the container, the pin and its associated structure serves as a pivot for opening and closing the cover-base. An upwardly extending flex-tab 35, as seen in FIG. 1, is provided with a locking flange 36 which is capable of being received within a recess 37 located on the inner surface cover of front wall 27. Accordingly, as the cover is closed, the flex-tab 35 flexes with the inner surface of front wall 27 to securely hold the cover and base together.

Figure 5:
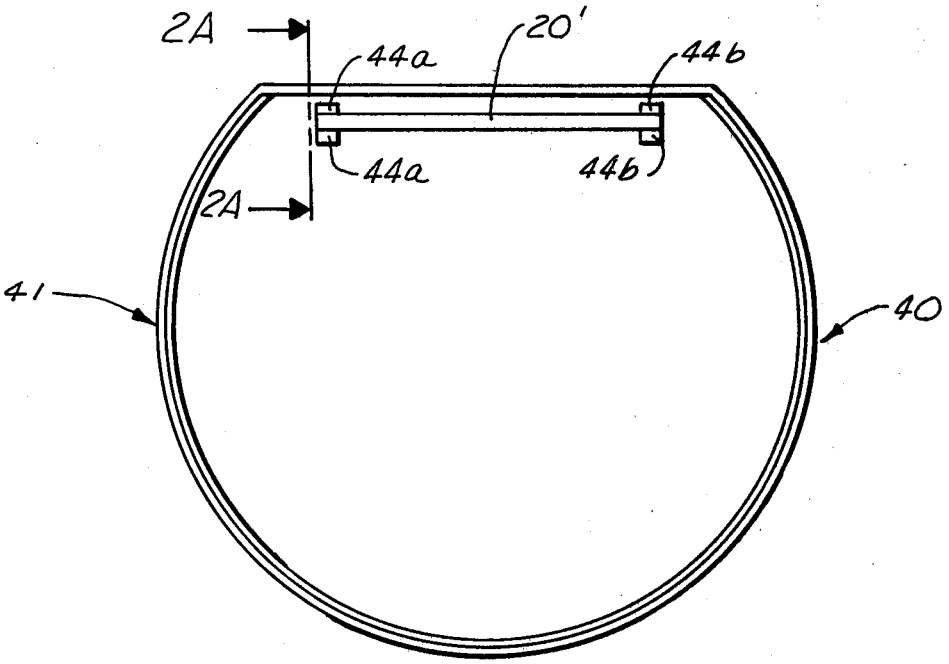
FIG. 5 is a plan view of the base of another embodiment of the invention.
Figure 2A:
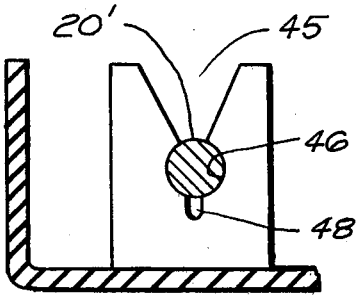
Figure 6:
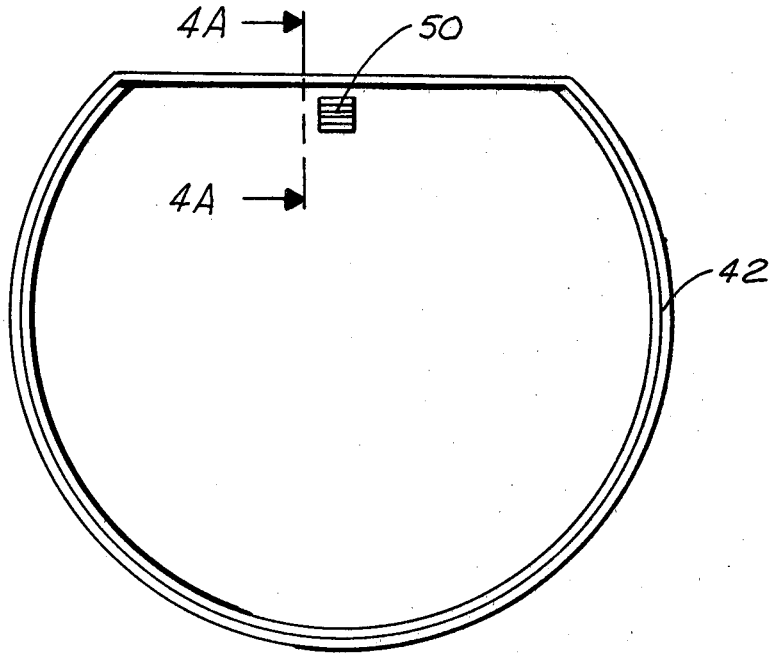
FIG. 6 is a plan view of the cover of another embodiment of the invention.

In another embodiment of the invention, as seen in FIGS. 5 and 6, a container, generally of an annular configuration, includes a base 41 and a complementary cover 42. Located within base 41 are a pair of opposing shoulder portions 44A—44A and 44B—44B, which are located in substantially parallel relationship to each other. The shoulder portions 44A—44A and 44B—44B are structured substantially similar to the shoulder portions depicted in FIG. 2–2A. According, a hinge pin 20' is snapfitted through the neck portion and located within the circular opening of each shoulder portion.

Figure 4A:
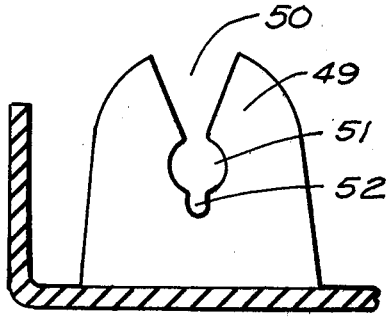

Cover 42 is provided with a projection 49, which is structured substantially similar to the projection depicted in FIG. 4–4A. The projection 49 preferably is located in the cover such that it is positioned between base shoulders 44A—44A and 44B—44B, when the base 41 is joined with cover 42. As the base 41 and cover 42 are mated, hinge pin 20' is snap-fitted through the projection neck portion and located within the projection circular opening.

It shall be understood that in other embodiments of the invention, the base shoulders and cover projections can either be in an reversed position or alternately arranged.

I claim:

1. A plastic container which comprises a first body, a second body for uniting with said first body to form an enclosure, when located within opposing relationship, and a pivotal pin having a body portion and end portion;

said first body having at least one pair of shoulders moulded therein in opposing relationship to each other, said pair of shoulders each having an opening therein for receiving and holding the respective end portions of said pin which is capable of being snap-fitted therein; and, said second body having at least one moulded projection having an opening therein for receiving and holding the body portion of said pin when the first body is united with the second body, thereby rendering any portion of the pin invisible external the container.

2. A plastic container which comprises a base, a cover for mating with the base and thus forming an enclosure, and a pivotal pin having a body portion and end portions;

said base including a pair of opposing side walls, a front wall and a rear wall; said rear wall having near its opposing ends a pair of moulded opposing shoulders, each shoulder having an opening therein capable of receiving and holding the respective end portions of said pin which is capable of being snap-fitted therein; said shoulder openings concealing the end portions of the hinge pin within said base to thereby render same non visible external the container; and said cover including a pair of moulded projections located between each pair of shoulders respectively, and having an opening therein capable of receiving and holding the body portion of said hinge pin therein for providing pivotal action when the base is united with the cover.

3. A plastic container, according to claim 2, wherein each pair of shoulders is provided with a slot therebetween for fully receiving its respective projection therein, such that the projection substantially fills such slot.

4. A container, according to claim 3, wherein said shoulder slot extends a predetermined height and the projection extends a sufficient height from its wall, so that the shoulder slot is substantially filled by its respective projection upon the insertion of the projection and its snap fit with the body of the hinge pin.

5. A container, according to claim 4, wherein there is relative pivital movement between the cover and base upon the snap-fit of the projection with the pin body portion.

6. A container, according to claim 5, wherein each shoulder is provided with a tapered neck portion which decreases to a size such that it is smaller than the diameter of the hinge pin to provide a snap-fit of the pin within the shoulder opening.

7. A container, according to claim 6, wherein each projection is provided with a tapered neck portion which decreases to a size such that it is smaller than the diameter of the hinge pin to provide a snap-fit of the pin within the projection opening.

* * * * *